United States Patent [19]

Milliken

[11] Patent Number: 4,850,597

[45] Date of Patent: Jul. 25, 1989

[54] TRADING AND SAILING BOARD GAME

[76] Inventor: Andrew C. Milliken, P.O. Box 200, South and Center Sts., Patterson, N.Y. 12563

[21] Appl. No.: 115,839

[22] Filed: Nov. 2, 1987

[51] Int. Cl.[4] ..... A63F 3/00

[52] U.S. Cl. ..... 273/254; 273/256; 273/286; 273/290

[58] Field of Search ..... 273/246, 251, 252, 254, 273/256, 286, 290, 243, 146

[56] References Cited

U.S. PATENT DOCUMENTS

| | | | |
|---|---|---|---|
| 436,310 | 9/1890 | Hoyt | 273/243 |
| 2,185,556 | 1/1940 | Johnson | 273/256 |
| 2,455,519 | 12/1948 | Powers | 273/246 |
| 3,874,671 | 4/1975 | Smith | 273/254 |
| 4,070,026 | 1/1978 | Cambardella | 273/254 |
| 4,381,113 | 4/1983 | Simons | 273/286 |
| 4,643,430 | 2/1987 | D'Aloia | 273/290 |

FOREIGN PATENT DOCUMENTS

| | | | |
|---|---|---|---|
| 889725 | 2/1962 | United Kingdom | 273/246 |
| 2030875 | 4/1980 | United Kingdom | 273/254 |
| 2078118 | 1/1982 | United Kingdom | 273/256 |

*Primary Examiner*—Edward M. Coven

*Assistant Examiner*—Benjamin Layno

*Attorney, Agent, or Firm*—Joseph R. Carvalko, Jr.

[57] ABSTRACT

The board game apparatus is intended primarily to provide a game involving trading, negotiating, and sailing. In order that the principle of the invention can be readily understood, a single embodiment thereof is discussed. The object of the game is to accumulate wealth through transporting goods on a cargo sloop and trading with other players. The game apparatus allows the sloops to be realistically sailed from port to port purchasing and trading cargo. Movement of the sloop is governed by wind, tide, current and the skill of the player. An array of playing spaces arranged in a grid allows a plurality of paths between any two ports. Value of the cargo changes as it is transported from port to port increasing as the distance from the port of origin increases, which reflects the added cost of transportation. A doubling of cargo value occurs if the market for that commodity is cornered. Unforeseen events during the game may resupply cargo at ports. Thus, trading of cargo is stimulated. Eventually, cargo at the ports is depleted, sloops are removed from service, and the player with the greatest accumulated wealth wins the game.

28 Claims, 7 Drawing Sheets

63

*Manhattan*

MANUFACTURED GOODS EXCHANGE

1 TEXTILE = 1/3 MANUF. GOODS
BLUESTONE = 2 MANUF. GOODS
APPLE = 3 MANUF. GOODS
BRICK = 4 MANUF. GOODS
COAL = 5 MANUF. GOODS
FUR = 6 MANUF. GOODS
LUMBER = 7 MANUF. GOODS

64

*Nyack*

BLUESTONE EXCHANGE

1 TEXTILE = 2/3 BLUESTONE
MANUF. GOODS = 2 BLUESTONE
APPLE = 2 BLUESTONE
BRICK = 3 BLUESTONE
COAL = 4 BLUESTONE
FUR = 5 BLUESTONE
LUMBER = 6 BLUESTONE

65

*Newburgh*

APPLE EXCHANGE

1 TEXTILE = 1 APPLE
MANUF. GOODS = 3 APPLE
BLUESTONE = 2 APPLE
BRICK = 2 APPLE
COAL = 3 APPLE
FUR = 4 APPLE
LUMBER = 5 APPLE

66

*Fishkill Landing/Poughkeepsie*

BRICK EXCHANGE

1 TEXTILE = 1 1/3 BRICK
MANUF. GOODS = 4 BRICK
BLUESTONE = 3 BRICK
APPLE = 2 BRICK
COAL = 2 BRICK
FUR = 3 BRICK
LUMBER = 4 BRICK

67

*Kingston*

COAL EXCHANGE

1 TEXTILE = 1 2/3 COAL
MANUF. GOODS = 5 COAL
BLUESTONE = 4 COAL
APPLE = 3 COAL
BRICK = 2 COAL
FUR = 2 COAL
LUMBER = 3 COAL

*Catskill/Hudson*

FUR EXCHANGE

1 TEXTILE = 2 FUR
MANUF. GOODS = 6 FUR
BLUESTONE = 5 FUR
APPLE = 4 FUR
BRICK = 3 FUR
COAL = 2 FUR
LUMBER = 2 FUR

68

69

*Albany/Troy*

LUMBER EXCHANGE

1 TEXTILE = 2 1/3 LUMBER
MANUF. GOODS = 7 LUMBER
BLUESTONE = 6 LUMBER
APPLE = 5 LUMBER
BRICK = 4 LUMBER
COAL = 3 LUMBER
FUR = 2 LUMBER

*Fig. 8*

TRADING AND SAILING BOARD GAME

BACKGROUND OF THE INVENTION

This invention relates generally to board games and, more particularly, to board games of trading, board games of transporting cargo, and board games with sailing vessels. This game involves the trading of cargo, the transporting of cargo, and the sailing of vessels, and represents invention in each of the three areas as well as more specifically in the realm of board games that involve the trading and transporting of goods with sailing vessels. Board games are known which attempt to simulate the effects of some of these parameters. However, prior to the present invention, a board game which provides a realistic simulation of all of these conditions and which realistically balances skill and chance has not been developed.

SUMMARY OF THE INVENTION

It is one of the objects of the invention in its preferred form to provide an environment in which the trading of cargo, the transportation of cargo, and the sailing of vessels are related and interactive in a way that is entertaining and educational.

Another object of this invention is to provide a game of strategy with a combination of skill and chance as realistic as possible while being practical enough to be easily learned and played.

Another object of this invention is to balance the skill and chance in the game such that chance determines the conditions under which token movement must be made as well as the occurrence of events during a player turn, while skill is manifested in the overall strategy and the revision of that strategy during the game as well as in the movement of the player token under conditions that, although determined by chance, can be expected to fall into certain probability distributions.

Another object of this invention is to stimulate interaction between the players by creating an environment in which cooperation is encouraged and rewarded and in which competition between players is directed in a positive, constructive manner rather then in a destructive manner, thereby increasing potential enjoyment of the game by the players.

Another object of this invention is to allow for the education of the players during the play of the game in which the environment constructed is representative of an environment that is possible in nature, and preferably, recreative of an actual historical environment.

These and other objects shall be attained by the invention as described in more detail below.

DRAWINGS

To illustrate and bring a clearer understanding of the apparatus and objects of the invention, drawings are provided as explained below:

FIG. 8 is illustrative of the exchange cards with exchange rate tables relative to each commodity at its port of origin;

DESCRIPTION OF THE PREFERRED EMBODIMENTS

The present game apparatus, as disclosed herein, is a specific embodiment of the invention involving trading and sailing, it is to be understood that in its broader aspect the invention is not limited to the apparatus described.

Figure 1A:
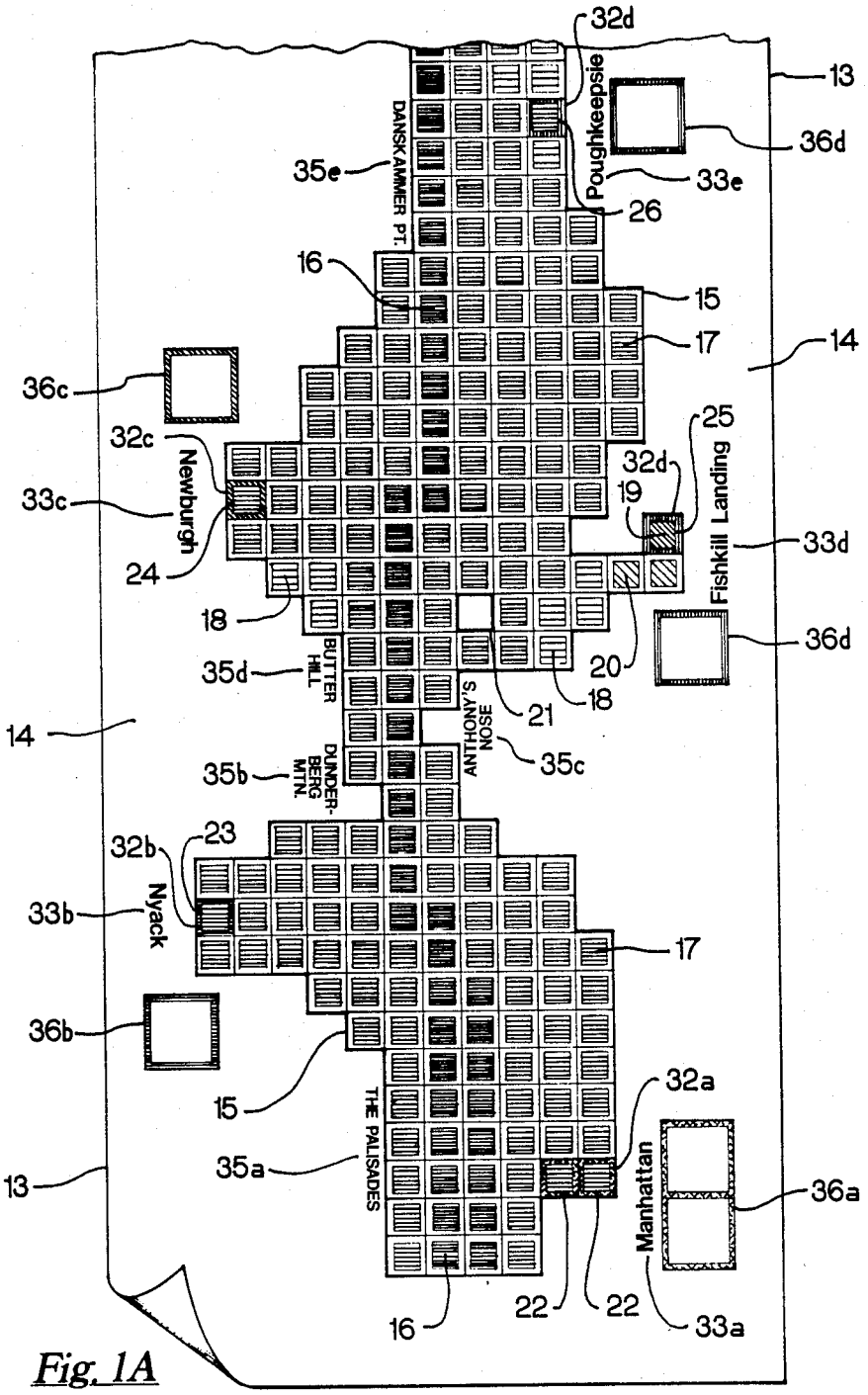
FIGS. 1A and 1B are a combination form of the game board showing the playing surface.
Figure 1B:
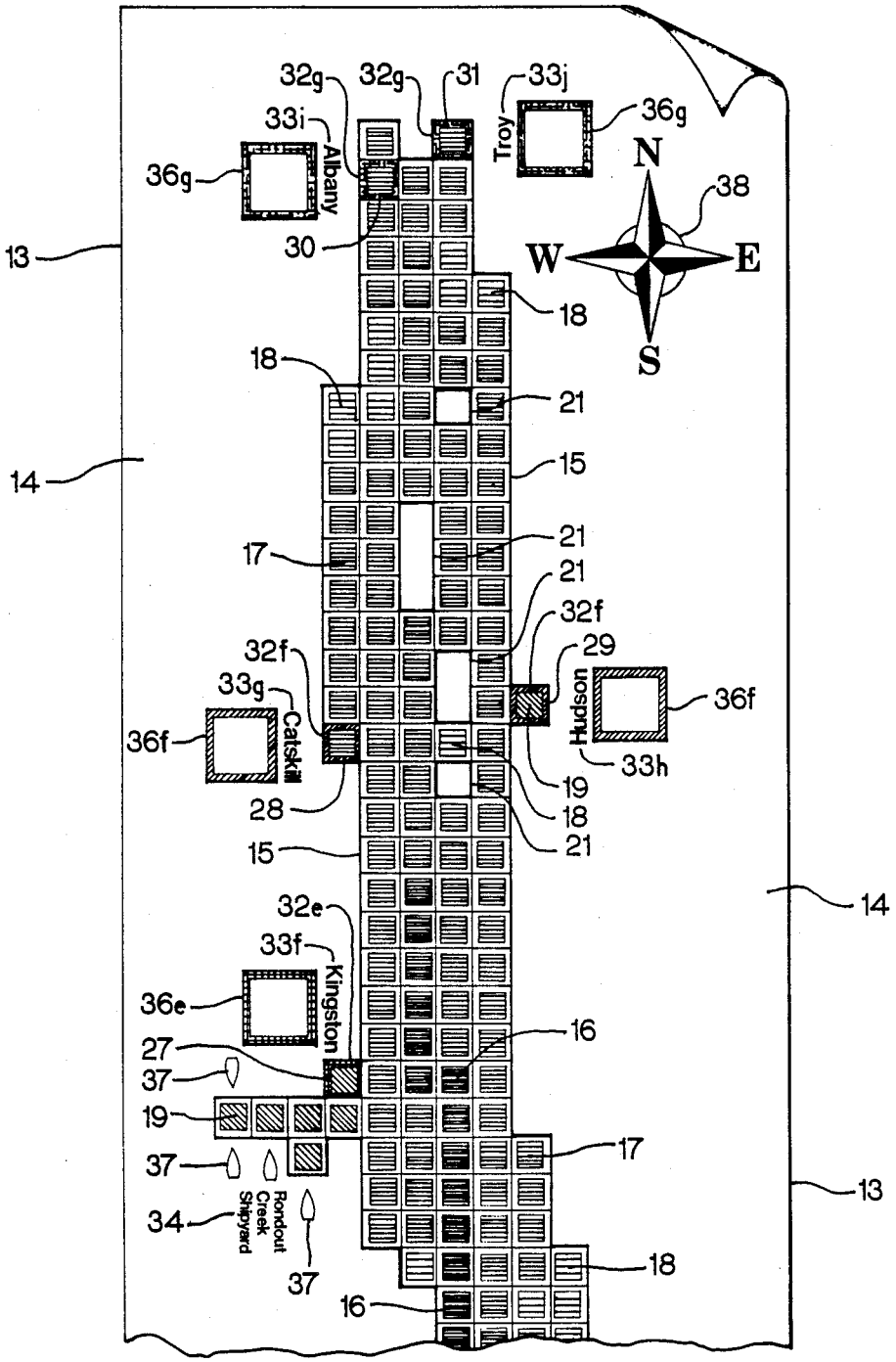

Referring now to the drawings and the elements thereof, labelled in all views with identical reference characters, FIGS. 1A and 1B are together the preferred game board 13 printed on one side 14 with a playing area 15 made up of a grid of square spaces with a border representing a coastline defining the body of water playing area 15. The square playing spaces are provided with distinguishing indicia according to the condition of the water in those spaces. in the preferred playing area 15, representing the Hudson River, there is a channel of deep and active water which runs generally in the center of the river. The playing spaces which comprise the channel are so designated by an inner square of dark blue 16. In the waters of the channel, a sloop may not anchor and currents are accelerated. The majority of the playing area is made up of navigable depth water with normal currents. The playing spaces which comprise these regular navigable waters are so designated by an inner square of medium blue 17. Certain areas in the river have normal currents but are shallow and not navigable at low tide. The spaces of shallow waters are so designated by an inner square of light blue 18. Protected parts of the river and its adjoining bays and creeks are free from currents. Protected spaces of navigable depth water are so designated by an inner square of medium green 19 while protected spaces of shallow water are so designated by an inner square of light green 20. Islands in the river 21 serve as obstacles to movement and are placed on the preferred game board generally where actual island masses exist in the Hudson River.

Port spaces 22–31 along the river are so designated by colored frames **32*a*–32*g* around their inner squares. The frames 32*a*–32*g* are colored to match the representative color of the native commodity, drawing a positive association between a port and its native commodity. Port names 33*a*–33*j* are printed near the port spaces to facilitate distinction of ports. In the preferred game the port names are names of actual towns and cities operating as ports on the Hudson River during the time frame of the game. The ports and their native commodities are: Manhattan 33*a* manufactured goods and textiles, Nyack 33*b* bluestone, Newburgh 33*c* apples, Fishkill Landing 33*d* and Poughkeepsie 33*e* brick, Kingston 33*f* coal, Catskill 33*g* and Hudson 33*h* fur, Albany 33*i* and Troy 33*j* lumber. In addition, the shipyard provided for the storage of tokens available for sale, is labelled as the Rondout Creek Shipyard 34, based on the fact that a substantial amount of shipbuilding took place in that area. Indicia representing storage areas 37 for available sloops are provided near the shipyard. Other place names, such as those shown 35***a*–35*e*, are provided to relate these places in the Hudson Valley to the rest of the playing area of the river, while not affecting play directly.

Square areas of color are provided near every port for the placement of the available cargo at each port. These cargo stores 36*a*–36*g* are colored appropriately for the commodity native to their respective ports. In the case of Manhattan, the store 36*g*, colored for manufactured goods, is divided to allow storage for textiles also.

A compass rose 38, accurately oriented, is provided large enough to be seen by all the players and indicates the directions from which a wind would blow and the direction of flow of a particular current.

Figure 2:
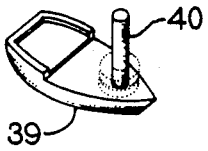
FIG. 2 is a perspective view of a typical sloop playing token.
Figure 3:
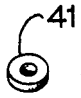
FIG. 3 is a perspective view of a typical cargo ring representative of ten tons of cargo.

The playing tokens 39, illustrated in FIG. 2, represent in the preferred game the Hudson River sloops that were dominant in the transporting of goods on the Hudson during the early 19th century. The sloop playing piece 39 is made of metal or of another suitable material heavy enough to remain upright on a cloth board and withstand collisions with thrown dice. Each sloop 39 has a mast 40 which serves as storage for cargo in transport. The cargo rings 41 (in a collective form referred to as cargo), one of which is illustrated in FIG. 3, each represents a fixed amount of cargo, preferably 10 tons. There is a maximum load on each sloop of preferably 8 cargo rings 41 representing a full load for an 80-ton sloop. The cargo rings 41 are colored appropriately for each commodity to draw an association between the color of the piece and its represented commodity and to distinguish between commodities. Each player's collection of cargo can be kept in front of him to represent his warehouse stores in Manhattan.

FIGS. 4A, 4B, 5A, and 5B illustrate typical dice used in determining wind directions, wind speeds, and the occurence of an event. In the preferred game, the wind direction die 42 has six faces with indicia as such: "N" (North) 43, "W" (west) 44, a sloop within a circle (indicia to represent the ocurrence of an event) 45, "S" (South) 46, "E" (East) 47. Note the repetition of the face showing a west direction 44. The resulting higher probability of a west direction is designed to reflect the prevalence of westerly winds on the Hudson. Each wind direction die 48 of two in the preferred game has six faces as such: "0" 49, "3" 50, "6" 51, "9" 52, "12" 53 where there is repetition of the "6" face 51. The numbers are wind speed in knots and are to be added together when rolled. The statistical probability distribution formed by these two dice will have the most common wind of 12 knots, and the least probable winds of 0 knots and 24 knots, as is likely in nature.

Figure 6:
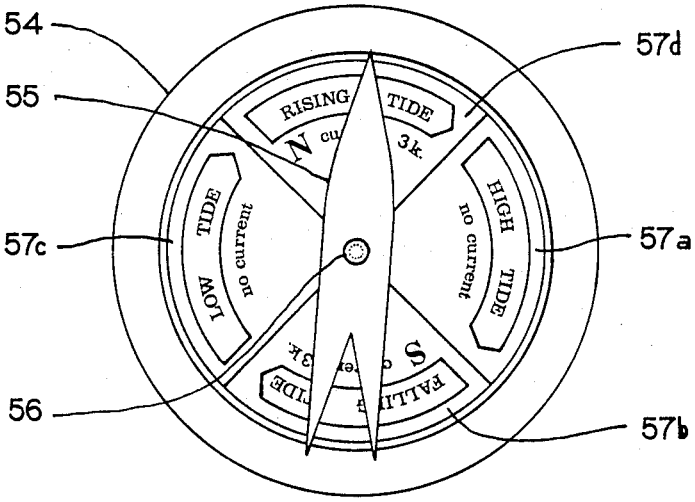
FIG. 6 is a plan view of the tide clock face and the adjustable indicator used to register the tide and any associated current.

The tides and currents inherent in the waters of the Hudson are represented as faithfully as is practical and are registered on a manually-operated tide clock in the preferred game. FIG. 6 can be used to illustrate the purpose of the tide clock. On the upper face of the tide clock 54, preferably of wood, is printed a representation of a clock divided up into segments for the four main modes of the river, with a high tide segment 57*a*, a falling tide segment 57*b*, a low tide segment 57*c*, and a rising tide segment 57*d*. Currents associated with the different modes are provided in each segment such that, for the example illustrated, "no current" is printed in the high tide segment 57*a* and in the low tide segment 57*c*; "S current 3 k." is printed in the falling tide segment 57*b*; and "N current 3 k." is printed in the rising tide segment 57*d*. A pointer 55 connected to the tide clock by a fastening mechanism 56 at the central point on the tide clock face 54 can be rotated manually to indicate the present condition of the river. The operation of the tide clock is further described below.

Figure 7:
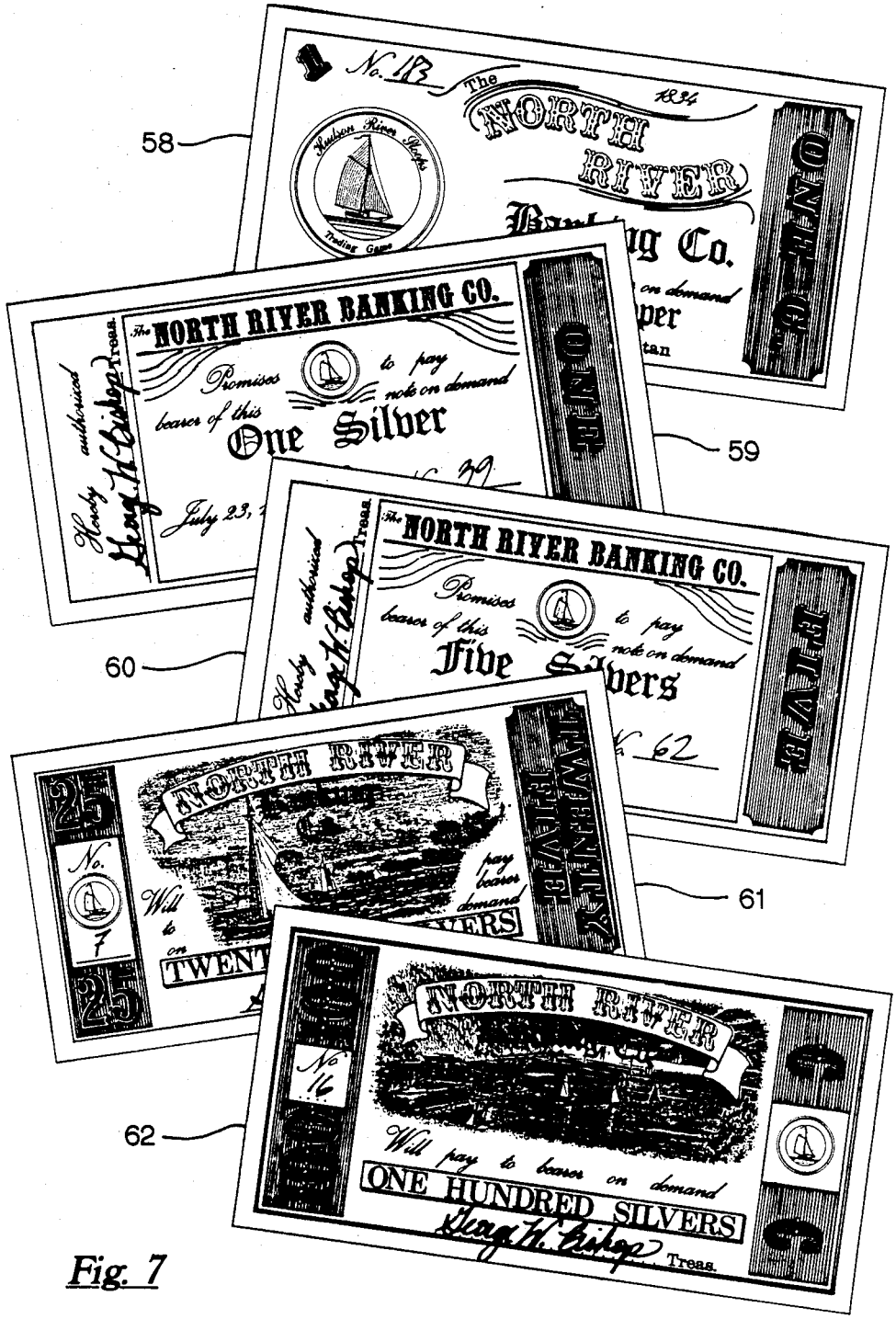
FIG. 7 is illustrative of the bank certificates to represent value in the game in denominations of 1 copper, 1, 5, 25, and 100 silvers.

In FIG. 7 are illustrated bank certificates in denominations of one copper 58, one silver 59, five silvers 60, twenty-five silvers 61, and one hundred silvers 62. These are to represent value in the preferred game. They can be used as money would be used in buying cargo 41 (FIG. 3) from the port at Manhattan 22 (FIG. 1A), negotiating for cargo 41 or sloops 39 (FIG. 2) of other players, and paying the maintenance and rental fees on a player's warehouse and crew wages on each slope 39 run by a player. In the preferred game, these certificates 58–62 are styled similar to those issued by individual banks in the 18th and 19th century, contemporary with the proposed setting of the game.

Tables of exchange rates as illustrated in FIG. 8 are provided to establish fixed relations of value between commodities at each portion the preferred game. The seven exchange cards are provided for manufactured goods in Manhattan 63, bluestone in Nyack 64, apples in Newburgh 65, brick in Fishkill Landing and Poughkeepsie 66, coal in Kingstone 67, fur in Catskill and Hudson 68, and lumber in Albany and Troy 69. The exchange cards list trading rates of any cargo traded for native cargo at a port.

Figure 9:
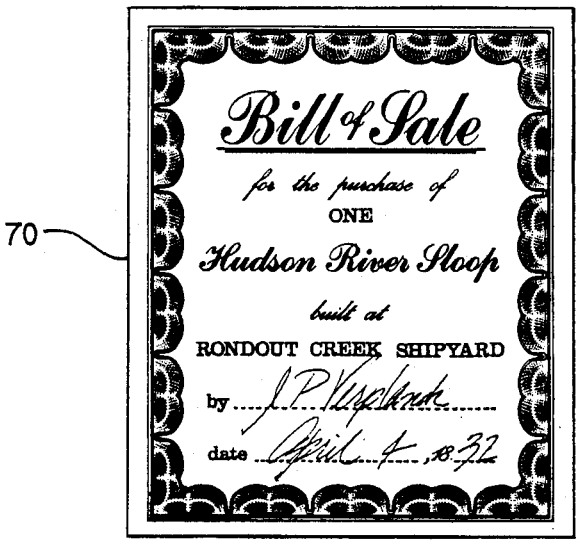
FIG. 9 is a illustrative of a typical bill of sale indicating ownership of a particular sloop playing token.

In the preferred game each sloop playing token 39 (FIG. 2) has a notice of ownership a bill of sale 70 as illustrated in FIG. 9. The bills of sale 70 are colored to match with their associated sloops as well as to distinguish between them.

Figure 4A:
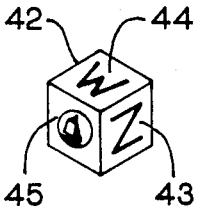
FIG. 4A and 4B are opposite isometric views of the wind direction die, including indicia on one face representing the Event face of the die.
Figure 4B:
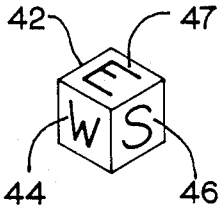
Figure 5A:
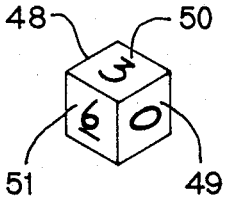
FIGS. 5A and 5B are opposite isometric views of a typical wind speed die.
Figure 5B:
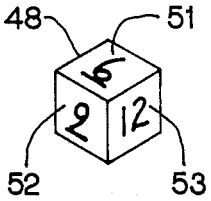
Figure 10A:
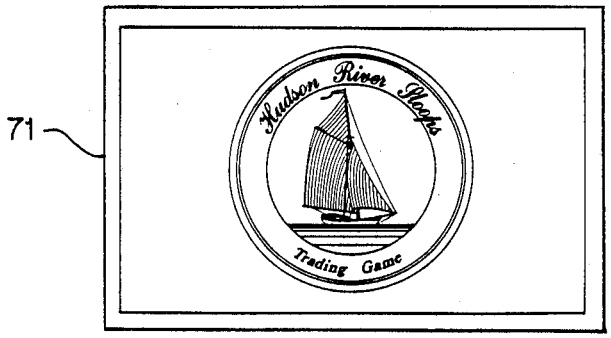
FIGS. 10A and 10B are top and bottom views of a selection of typical so-called Event cards.
Figure 10B:
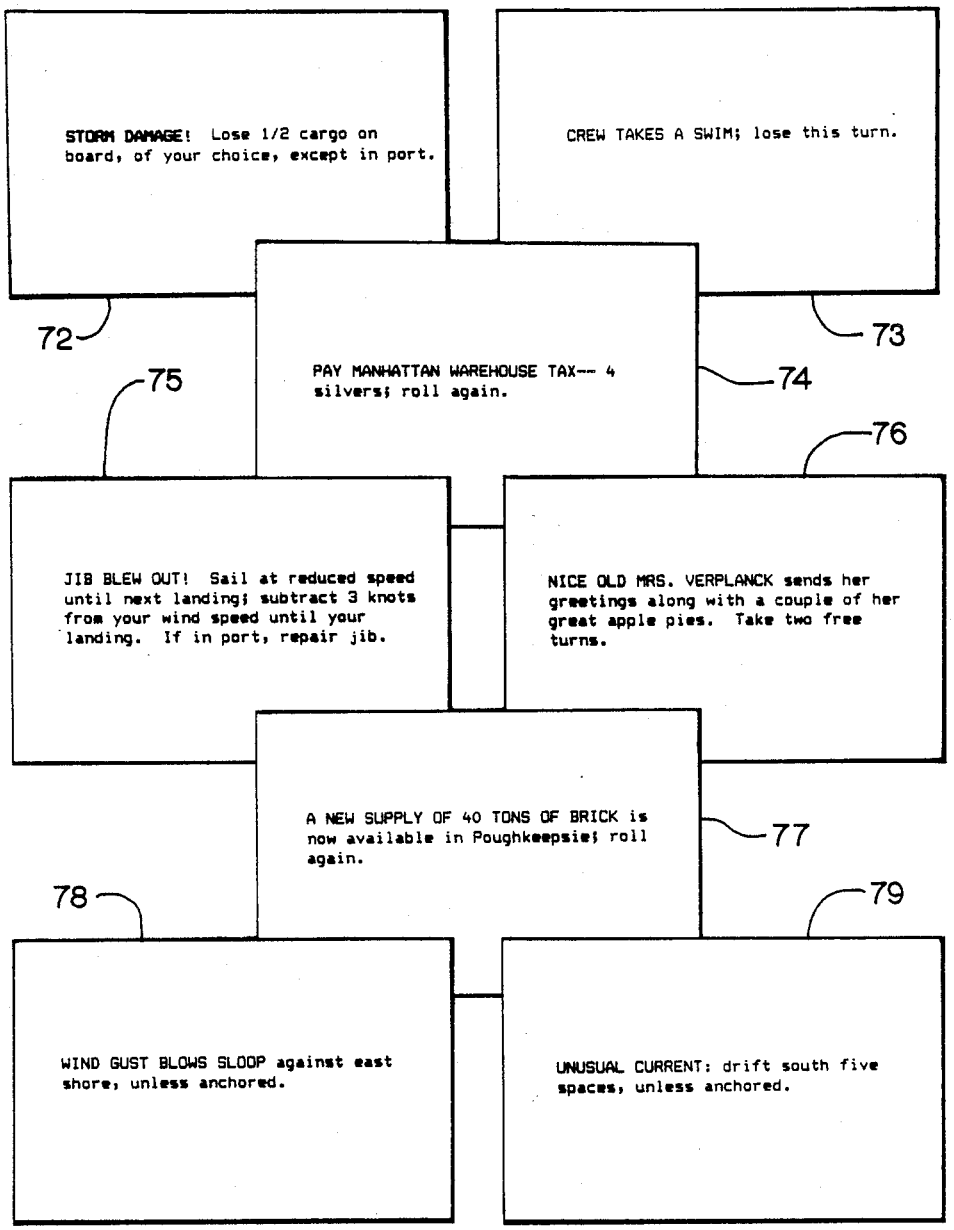

Illustrated in FIGS. 10A and 10B are the back and the faces of a representative sample of event cards used in the preferred form of the game. These cards are placed face down in a stack to be drawn from at the occurence of an event. The back of these cards 71, contains indicia to establish these cards as even cards and which is similar to one side 45 (FIG. 4A) of the wind direction die 42 (FIGS. 4A and 4B). Samples of typical events are shown in FIG. 10B. Some events are negative, such as the cargo lost card 72, the turn lost card 73, the warehouse tax card 74, and the mechanical failure card 75. Some events are positive, such as the extra turn card 76. Other cards are neutral, such as the resupply card 77, and the unusual weather condition cards 78 and 79.

From two to six players can effectively play the preferred game. The apparatus is designed to stimulate interaction between the players and rewards cooperation between players. The elements of chance and skill have been carefully balanced to achieve a challenging and enjoyable game. A considerable understanding of the principles of sailing can also be obtained from the apparatus. A knowledge of the history and geography of the setting is imparted through the design of the board, events, cargo and bank notes.

The game board 13 (FIGS. 1A and 1B) is patterned to simulate the Hudson River with a matrix of playing squares 15 which follow the twists and turns of the river from New York City to Troy. Six playing tokens 39 (FIG. 2) are provided which are crafted to resemble the Hudson River sloops, the main method for transporting goods on the river early in the 19th century. Eight commodities are represented by cargo rings 41 (FIG. 3) of eight colors: Manhattan manufactured goods (orange), Manhattan textiles (white), Nyack bluestone (blue), Newburgh apples (green), Fishkill Landing brick and Poughkeepsie brick (red), Kingston coal (black), Catskill fur and Hudson fur (brown), Albany lumber and Troy lumber (yellow).

Up to eight cargo rings 41 (FIG. 3) can be carried on each sloop 39 (FIG. 2) and fit over the mast 40. Each cargo ring 41 represents approximately 10 tons of cargo. Textiles are worth one-third that of manufactured goods. The value of the cargo varies as it is transported according to the exchange rate tables on the exchange cards 63-69 (FIG. 8) for each commodity. In principle, as the distance from a commodity's port of origin increases, so does its value.

Each player begins the game with a sloop 39 (FIG. 2) and an accompanying bill of sale 70 (FIG. 9) in Manhattan 22 (FIG. 1A) and bank certificates 58-62 (FIG. 7) in the amount of 40 silvers. The remaining sloops are stored at the Rondout Creek Shipyard 34 (FIG. 1B) where they may be purchased by delivering the equivalent of 700 tons of coal (14 cargo rings 41 (FIG. 3) of manufactured goods, for example) to the shipyard 34 by sloop. At the end of the game, sloops are valued at 35 silvers for the purpose of determining the winner. Each player, in a turn, pays one copper certificate 58 for warehouse maintenance and one copper certificate 58 for crew wages for each sloop 39 running, then rolls the wind speed and direction dice 48 and 42 (FIGS. 4A, 4B, 5A, and 5B) once for each sloop 39 running. The numerals facing up on the wind speed dice 48 are summed to provide a total wind speed in knots and the third die 42 gives the direction from which the wind is blowing. The tide and current are read from the tide clock 54 (FIG. 6) which is advanced one quarter turn for each round of play. The player may then move his sloop 39 according to the following rules: perpendicular to the wind for a number of spaces equal to the full strength of the wind in knots used in that direction; with the direction of the wind for a number of spaces equal to two-thirds the strength of the wind in knots used in that direction; into the wind for a number of spaces equal to one-third the strength of the wind in knots used in that direction. The effect of the current must be included when making a move. There are usually a large number of moves possible with any particular set of conditions and skill is required to select the most strategic move for the greatest possible benefit.

The inner squares of the gameboard spaces 16–20 (FIGS. 1A and 1B) are of various colors representing different river conditions: dark blue 16 representing deep channel water with accelerated currents of four knots; medium blue 17 representing navigable depth water with currents of three knots; light blue 18 representing shallow water with currents of three knots and not navigable at low tide; medium green 19 representing navigable depth water without currents; light green 20 representing shallow water without currents and not navigable at low tide.

Ports 22-31 (FIG. 1A and 1B) are denoted by frames **32*a*–32*g* surrounding the inner squares 17, 19** of a port space colored to match the native commodity.

The object of the game is to sail the sloops 39 (FIG. 2) upriver with cargo 41 (FIG. 3), trade for cargo 41 at various ports 22-31 (FIGS. 1A and 1B) and with sloops 39 on adjacent squares and return to Manhattan 22 wherein the cargo 41 is unloaded and stored in the player's warehouse, thus accumulating cargo value. A player may make as many trips upriver and down as he wishes to accumulate cargo value. If a player obtains all the available cargo 41 of a particular commodity, he corners the market for that commodity and the value of his store of that commodity in Manhattan doubles. Consequently, trades between players are encouraged. Cargo 41 at the Manhattan warehouse can be sold at any time for bank certificates 58-62.

Unforeseen events did happen on the river and will occur during the game when the Event side 45 (FIG. 4A) of the wind direction die 42 (FIGS. 4A and 4B) is up. An Event card 71 (FIG. 10A) is taken from the top of the stack and the instructions, like the examples shown 72-79 (FIG. 10B), are followed. Events like 77 include the restocking of cargo at ports. Eventually, the cargo 41 (FIG. 3) will be exhausted, sloops 39 (FIG. 2) will be taken out of service, and the game will end with the player with the greatest total wealth in bank certificates, cargo, and sloops winning

What is claimed is:

1. A trading and sailing board game comprising:

a. a board having a grid denoting a body of water, said grid having a plurality of spaces each color coded to represent varying depth and currents, said color coding of spaces differently affecting the movement of tokens along the body of water a plurality of ports, a shipyard, a home port, a plurality of obstacles, and a compass rose;

b. a plurality of moveable tokens which represents sailing vessels to carry a cargo thereon;

c. a plurality of pieces representing said cargo having distinguishing indicia and whose value changes with board position;

d. a mechanism of chance, which determines wind speed, wind direction and occurrence of events;

e. a plurality of cards which is drawn from as indicated by said mechanism of chance;

f. a means to register the tide and current comprising a circular clock divided into segments and a rotatable pointer mounted centrally thereof, said segments having indicia representing changes in the tide and current, said indicia relating to said plurality of color coded spaces;

g. a means for indicating a value;

h. a means for establishing ownership of said tokens;

i. exchange cards.

2. The board game apparatus in accordance with claim 1 wherein the game board contains a grid of various colored squares indicating water depth, intensity of current, ports, a shipyard and obstacles upon which a token representing a boat can be manually moved over a variety of courses from any port to another and on which is printed a compass rose indicating North, South, East and West and which is suitably fashioned to represent a body of water and which may be made from cloth to be rolled up for storage.

3. The board game apparatus in accordance with claim 1 wherein the mechanism of chance determining wind speed, wind direction and occurances of events are three dice, where two dice define wind speed and the remaining die defines wind direction and occurance of an event, the wind speed dice have numbers on the faces which together form a statistical probability distribution similar to that found in nature.

4. The board game apparatus in accordance with claim 3 wherein the dice simulate actual sailing conditions where a player can choose to use as much of the wind as he wishes during a move by trimming the sails.

5. The board game apparatus in accordance with claim 1 wherein bank certificates, cargo pieces and token titles represent value and where bank certificates may be in denominations of 1 copper, 1, 5, 25 and 100 silvers and where a copper certificate may be valued at one third of a silver certificate and where bank certificates can be traded for cargo and where bank certificates can be used for the purpose of paying a maintenance fee on a player's cargo warehouse and for the purpose of paying crew wages for each of a player's tokens in play in each player's turn.

6. The game in accordance with claim 1 wherein the tokens are modeled to represent sailing ships having a mast for storage of a plurality of cargo rings distinguished by color which can trade cargo with other vessels.

7. The game in accordance with claim 1 wherein the cargo rings are annularly formed to fit on the mast.

8. The game in accordance with claim 1 wherein said mechanism of chance determines the wind speed, wind direction, and occurrence of an event with established probability distribution.

9. The game in accordance with claim 8 wherein the said mechanism of chance is composed of dice whereby any two of said dice have numbers divisible by three specifying the movement of said token vessels.

10. The game in accordance with claim 9 wherein the said probabilities are determined by the throw of three dice, whereby two dice are the same and together determine the wind speed and wherein the remaining die determines the wind direction and occurrence of an event.

11. The game in accordance with claim 10 wherein a set of event cards are drawn when the event side of the wind direction die is rolled, which explains the event including restocking of supplies at the trading ports simulating the production of commodities locally, which causes restocking to occur periodically at random intervals.

12. The game in accordance with claim 10 wherein the wind speed dice have numbers on the faces which together form a statistical probability distribution such that the most frequent wind will be twelve knots and the least frequent winds will be zero and twenty four knots.

13. The game in accordance with claim 10 wherein the wind direction die has indicia on each face such that wind directions appear on a number of sides proportional to their frequency of occurrence and such that a proportional number of sides define the occurrence of an event.

14. The game in accordance with claim 1 wherein a card from the plurality of cards is drawn on the occurrence of an event.

15. The game in accordance with claim 1 wherein particular cards from the plurality of cards demand restocking of cargo at a port.

16. The game in accordance with claim 1 wherein each exchange card defines the value of foreign cargo in terms of commodity at a receiving port.

17. The game in accordance with claim 16 wherein said exchange card provides values of cargoe dependent upon the receiving port location in relation to the port of origin of said cargo.

18. The game in accordance with claim 1 wherein said grid representing a body of water includes spaces of shallow water which are not navigable at low tide thus redefining the playing area at regular intervals.

19. The game in accordance with claim 1 wherein the tokens represent sailing vessels to be moved on the spaces of the playing area, which have masts of a specific size for the storage and display of a limited amount of cargo and which are provided with distinguishing indicia.

20. The game in accordance with claim 1 wherein the cargo rings are divided into categories distinguished by color representing different commodities, each of which fit over the mast of the sailing token, each representing a fixed quantity of cargo, which is easily loaded on and unloaded from the token sailing vessel, which has a value dependent upon board position, which can be traded for other cargo exchanging the value of goods carried by the vessel, which further provides an association between cargo type, quantity, and token vessel, which can be cornered when all the rings of one commodity are owned by one player, causing the value of the cargo to double.

21. The game in accordance with claim 1 wherein the said grid consists of a perimeter region and an inner region whereby each space is characterized by indicia in the perimeter region thereby establishing a particular aspect of a grid such as ports as well as by indicia in the inner region, establishing a separate aspect of a grid, such as water depth, thus allowing a single space to be associated with more than one characteristic.

22. The game in accordance with claim 21 wherein the indicia associated with a grid can establish the grid as calm water and thereby unaffected by tidal currents.

23. The game in accordance with claim 21 wherein the indicia associated with a grid can establish the grid as navigable water in which a sailing vessel can anchor, and thereby avoid adverse effects of current.

24. The game in accordance with claim 21 wherein the indicia associated with a playing space can establish the grid as deep water in which a sailing vessel cannot anchor, whereby the sailing vessel will be affected by tidal currents.

25. The game in accordance with claim 1 wherein a plurality of grids is designated as a shipyard where vessels are stored, traded for cargo, and launched.

26. The game in accordance with claim 1 wherein said tide clock is comprised of a pointer fastened to impede free spinning until reset.

27. A trading and sailing board game comprising:

a. a board, preferably cloth, having a grid denoting a body of water, said grid having a plurality of spaces each color coded to represent varying depth and currents said color coding of spaces differently affecting the movement of tokens along the body of water, a plurality of ports a shipyard, a home port, obstacles such as islands, and a compass rose;

b. a plurality of moveable tokens which represent sailing vessels to carry a cargo;

c. a mechanism of chance which determines wind speed, wind direction and occurrence of events;

d. a plurality of pieces representing said cargo having distinguishing indicia and whose value changes with board position;

e. a plurality of cards which is drawn from as indicated by said mechanism of chance;

f. a means which can be set manually to register the tide and current comprising a circular clock divided into segments and a rotatable pointer mounted centerally thereof, said segments having indicia representing changes in the tide and current, said indicia relating to said plurality of color coded spaces;

g. a plurality of bank certificates for indicating a value;

h. a plurality of titles for creating ownership in said tokens;

i. exchange cards which define the value of foreign cargo.

28. A trading and sailing board game comprising:

a. a board, having a grid denoting a body of water, said grid having a plurality of spaces each color coded to represent varying depth and currents said color coding of spaces differently affecting the movement of tokens along the body of water, a plurality of ports at which cargo can be traded, a shipyard for the storage of tokens, a home port, obstacles and a compass rose;

b. a plurality of moveable tokens which represent sailing vessels to carry a cargo;

c. a mechanism of chance which determines wind speed and wind direction;

d. a plurality of pieces representing cargo having distinguishing indicia and whose value changes with board position;

e. a plurality of cards which is drawn from as indicated by said mechanism of chance;

f. a means which registers the tide and current comprising a circular clock divided into segments and a rotatable pointer mounted centrally thereof, said segments having indicia representing changes in the tide and current, said indicia relating to said plurality of color coded spaces;

g. means for indicating a value;

h. a means for creating ownership in said token;

i. a means for exchange.

* * * * *